US005470072A

United States Patent [19]

Cunningham

[11] Patent Number: 5,470,072

[45] Date of Patent: Nov. 28, 1995

[54] GOLF PRACTICE DEVICE

[76] Inventor: Tom Cunningham, 1802 Crenshaw Blvd., Los Angeles, Calif. 90019

[21] Appl. No.: 292,587

[22] Filed: Aug. 18, 1994

Related U.S. Application Data

[63] Continuation of Ser. No. 846,899, Mar. 6, 1992, abandoned.

[51] Int. Cl.[6] ..... A63B 69/36

[52] U.S. Cl. ..... 273/186.3; 359/109

[58] Field of Search ..... 273/186.2, 186.3, 273/186.4, 193 R, 193 A, 194 R, 194 A, 194 B

[56] References Cited

U.S. PATENT DOCUMENTS 2,787,470 4/1957 Barrus et al. ..... 273/186.3
3,191,939 6/1965 Hooper ..... 273/186.3
3,753,564 8/1973 Brandell ..... 273/186.2

FOREIGN PATENT DOCUMENTS 2110095 6/1983 United Kingdom ..... 273/186.3

OTHER PUBLICATIONS

Golf Magazine, Apr. 1992, vol. 34, No. 4–"The Golf Course 18th Hole Faults–'Slicer's Corner'", p. 112.

*Primary Examiner*—George J. Marlo
*Attorney, Agent, or Firm*—Robert D. Fish

[57] ABSTRACT

A golf practice device and method are described whereby bright colored light sources are affixed to a shaft, head or other part of the device, in such manner that the light sources appear to trace out one or more visual distinct patterns during a swing. The degree to which the patterns overlap and the colors appear to merge indicates the degree to which the user is swinging the device in a preferred manner.

7 Claims, 1 Drawing Sheet

GOLF PRACTICE DEVICE

This application is a Continuation application Ser. No. 07/846,899, filed on Mar. 6, 1992, now abandoned.

BACKGROUND OF THE INVENTION

The present invention relates to the field of golf equipment.

Golf is a game in which one or more clubs are used to hit a ball into a series of cups. A club typically comprises a handle and a head connected by a shaft, the club being swung so that the face of the head strikes the ball. The alignment of the head at the point of impact with the ball is critical in that it largely determines the direction of motion of the ball. Part of the skill of golfing is the ability to align the club in the proper alignment, neither "toe-in" which hooks the ball, nor "toe-out" which slices the ball. The terms "hook" and "slice" are used in the sense normally attributed to them by golfers. A "hook" describes a mid-flight veering of the ball to the side of the dominant hand, while a "slice" describes a mid-flight veering of the ball to the side of the non-dominant hand. Learning to swing the club in the proper alignment is difficult for many individuals. The difficulty may be especially great when using a club such as a driver which has a relatively long shaft and a relatively heavy head.

One solution is to practice swinging at a relatively large number of balls at a driving range. This solution provides rapid feedback on each swing, and the golfer can attempt to adjust his swing accordingly. There are, however, significant drawbacks. A driving range may be expensive, inconveniently located, crowded, intemperate or even closed at the time the golfer wishes to use it. Further, the feedback to the golfer regarding the nature of his swing is delayed by several seconds. A golfer often cannot tell whether he has hooked, sliced or hit the ball square until after the swing is over and the ball is well down range. The word "square" as used in this application is defined as the proper horizontal alignment of the face of a club head with respect to a ball, i.e. neither toe-in nor toe-out. Any alignment other than a square alignment is considered to be non-square.

Another solution is for a golfer to practice his swing in front of an instructor, or in front of a video camera. In both instances the golfer can improve his swing over time, but the speed of improvement is hampered by the delay in feedback.

SUMMARY OF THE INVENTION

The present invention resolves these problems by providing immediate feedback on a golfer's swing, without the need for traveling to a driving range or other special location, without the need for intervention by an instructor, and without the need for expensive video equipment. In general, light sources, or simply "lights", are affixed to a shaft in a manner that enhances visual feedback regarding the alignment of the shaft during the swing. Where the shaft is a golf club, the light sources may be affixed to a club head. When the shaft is swung properly, a "square" swing, the movement of the light sources forms visually distinguishable arc patterns which are characteristic of square swings. One such pattern comprises superimposed arcs in the air at or near the point of impact with the ball. Conversely, when the club is swung improperly, "toe in" or "toe out" the light sources will not form patterns characteristic of square swings, and, for example, will appear to form separate, non-superimposed arcs. The term arc is used herein to mean any visualizable pattern of light resulting from movement of a light. The term superimposed is used herein to mean that the arcs appear to the golfer substantially as a single curve. Using a device or method according to the present invention, a golfer can rapidly improve his swing by repeatedly swinging, observing the patterns traced by the light sources during the swing, and adjusting the swing accordingly.

Accordingly, it is an object of this invention to provide a golf practice device which enhances visual feedback regarding the alignment of the golf club during the swing.

It is a further object of this invention to enhance a golfer's ability to improve the alignment of his swing without going to a driving range, and without necessarily involving instructors or video-electronics.

These and other objects of the present invention will become better understood through a consideration of the drawing and description which follow.

BRIEF DESCRIPTION OF THE DRAWING

Submitted herewith is a drawing containing the following figures.

DETAILED DESCRIPTION OF THE INVENTION

Figure 1:
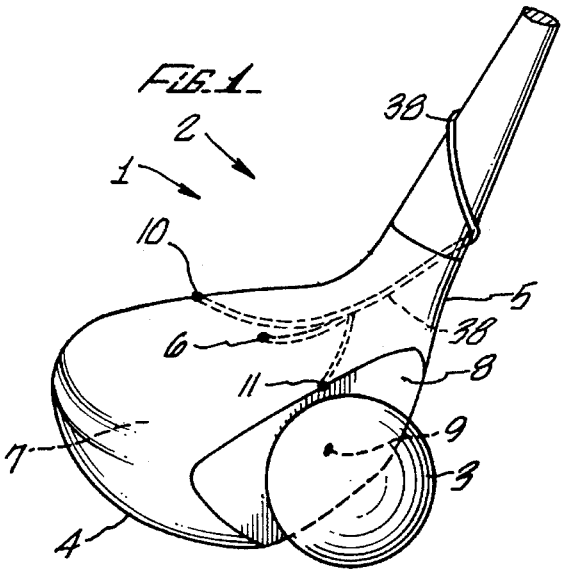
FIG. 1 is a front perspective view of a golf club head in a proper alignment with respect to the ball.

Turning now to the drawing, FIG. 1 generally depicts the head 1 of a golf club 2 juxtaposed against a golf ball 3. The head 1 has a toe 4 and a heel 5 defining the front and back of the head 1 respectively, and a crown 6 and a sole 7 defining the top and bottom of the head 1 respectively. The head 1 connects with a shaft 13 at the heel 5. One side of the head 1 typically has a face 8 or striking surface for hitting the ball 3 during a swing. The face 8 may be angled off-vertical to achieve a particular degree of loft. The particular club shown is a driver, but the same elements and principles apply by analogy to any other type of golf club including woods, irons, metal-woods and composites, putters, and also any similar device having a shaft even if such device does not include a golf club head or a distinct handle, or could not practicably be used for playing the game of golf.

Figure 2:
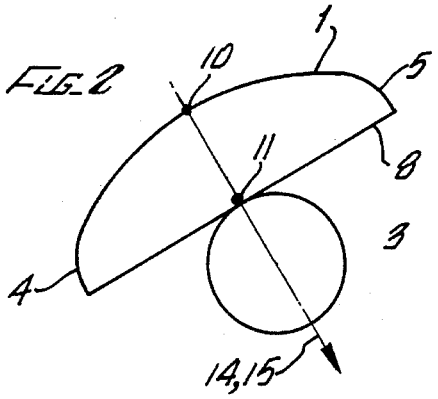
FIG. 2 is a plan view of a club head aligned square with respect to a golf ball.
Figure 3:
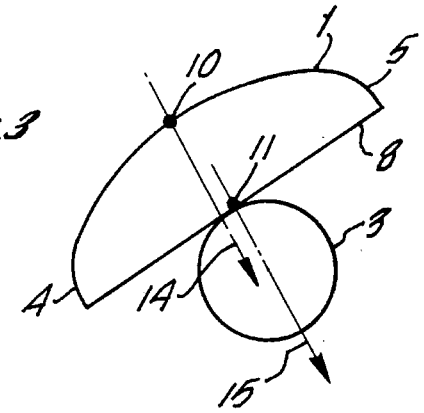
FIG. 3 is a plan view of a club head aligned toe in with respect to a golf ball.
Figure 5:
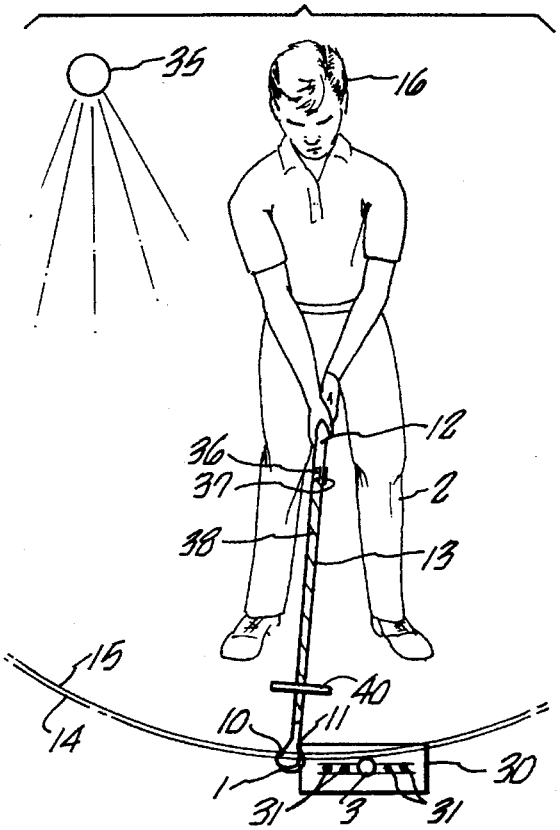
FIG. 5 is a perspective view of a golfer using a club according to the present invention.
Figure 4:
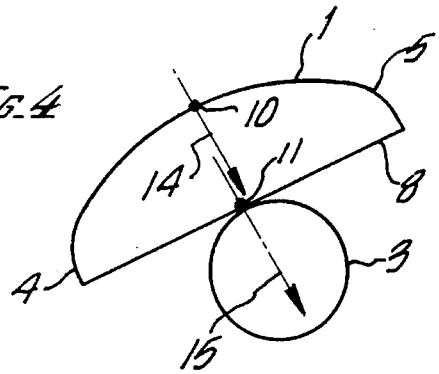
FIG. 4 is a plan view of a club head aligned toe out with respect to a golf ball.

In FIGS. 2 through 5, light sources 10, 11 trace out arcs 14, 15 respectively at or near the impact portion of a swing. FIGS. 2 through 5 specifically depict a right-handed club, but a left-handed club is analogous. If the club 2 is aligned "square" as shown in FIG. 2, the arcs 14, 15 will appear to a golfer 16 swinging the club 2 to be superimposed. If the club 2 is aligned "toe in" as shown in FIGS. 3 and 5, arc 14 will appear to the golfer 16 to be closer to the toe 4 than arc 15. If the club 2 is aligned "toe out" as shown in FIG. 4, arc 14 will appear to the golfer 16 to be closer to the heel 5 than arc 15. By practicing his swing and observing the degree to which the light sources 10, 11 are superimposed, a golfer 16 can alter his stroke and thereby improve the alignment of the club 2.

In a preferred embodiment depicted in FIGS. 1 through 5, two light sources 10, 11 are positioned flush within the crown 6, separated from each other by a maximal distance, and co-planar with the golfer's visual line of sight to a sweet spot 9. The sweet spot 9 is the ordinarily preferred part on the face 8 with which to hit the ball 3, and is typically located slightly towards the heel 5 from the center of the face 8.

The invention may be practiced with three, four or more light sources instead of two, the light sources need not be co-linear, and they need not be at the same height relative to the sole 7. Virtually any position of light sources and virtually any selection of light colors are suitable for the practice of the invention, so long as the arcs traced by the light sources during the swing produce a pattern for a square swing which is visually distinct and distinguishable from distinct patterns produced by non-square swings. By way of illustration only, and without limitation, the light sources may be placed within the head 1 (not shown) or along a bar 40 attached to the shaft 13 as in FIG. 5.

The light sources may be light emitters, reflectors or both. In the case of light emitting light sources, one or more batteries 36 (shown in FIG. 5) may be used to supply power to the light sources. The batteries are preferably attached to a handle 12, but may be contained within the handle 12, within the head 1, or attached elsewhere on or in the club 2, or may be external to the club 2. The handle 12 may be a physically separable attachment to the shaft 13, or it may be merely a portion of the shaft 13. A switch 37 (shown in FIG. 5) may be used to control the flow of power to the light sources through wires 38 (FIGS. 1 and 5). An inertial switch is presently preferred, such as may be actuated by swinging motion of the club 2 or position of the head 1.

The preferred embodiment uses light emitting diodes as light sources because they are relatively bright and consume a relatively small amount of power. Many other types of light emitting light sources could be used, including sources which are incandescent, fluorescent, chemiluminescent, reflective, or some combination of these. Illuminated strips or string lights can also be used. The light sources may also have different colors from each other to aid in distinguishing whether the golfer is swinging square, toe-in or toe-out, or for aesthetics. If the lights are of different colors, they may appear to produce a single superimposed arc having a color which is a combination of the various colors of the individual arcs.

Reflective light sources may be operated in conjunction with either ambient light or artificial light such as a strobe light. In FIG. 5, a strobe light 35 acts to "freeze" motion of the light sources during a stroke by giving the golfer an illusion of separate, consecutive swinging positions as opposed to a smooth, continuous swing. This illusion may enhance the golfer's ability to visualize the relative position of the light sources during the swing and thereby enhance the usefulness of the invention. Since a strobe light may act to drown out the brightness of light emitting light sources, strobe lights may be especially useful in combination with reflective light sources.

FIG. 5 further depicts a pad 30 under the sole 7 of the head 1 for use in visualizing the alignment of the light sources 10, 11. The pad 30 has markers 31 which correspond to the correct position of the light sources 10, 11 during the course of a square swing. In a preferred embodiment, the pad is approximately 12" by 24" by ½" thick, and is substantially covered with an artificial grass such as Astro-Turf (TM). A curvilinear ¼" wide strip 32 of white silicone injection molded gel is embedded in the pad 30 and illuminated from within or below the gel. The strip 32 has a single circular enlargement at its center in the approximate diameter of a regulation golf ball. In use, the golfer 16 would swing his club over the pad 30 and observe the degree to which the arcs 14, 15 superimposed the strip 32. The pad 30 is not necessary for practicing the invention, but some golfers may find it to be advantageous.

Figure 6:
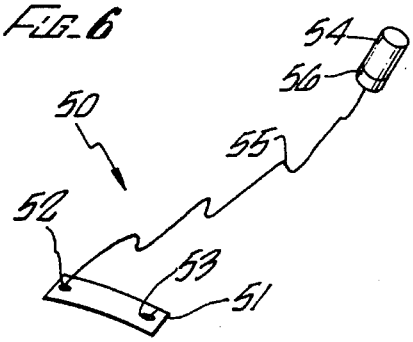
FIG. 6 is a schematic of a kit for converting an existing golf club.

FIG. 6 depicts another embodiment of the present invention comprising an adapter kit 50 for use with an existing golf club (not shown). The kit 50 comprises a strip 51 bearing light sources 52, 53 on its top side and attachable to the crown of the head of an existing golf club (not shown). The strip 51 may be designed for permanent affixation to the golf club, or may utilize a removable attachment means such as Velcro (TM). The light sources 52, 53 are powered by a battery pack 54 through wires 55. A switch 56 is electrically coupled to the battery pack 54 to control the operation of the light sources 52, 53. The battery pack 54 and switch 56 are attached to the shaft 13 of the golf club by clamps or other attachment means (not shown). The wires 55 are wrapped around the shaft 13. This embodiment may be especially desirable to a golfer because it enables him to gain the benefits of the present invention while practicing with one or more of the clubs that he would normally use in a game.

Thus, a golf practice device and method of improving a golfer's swing have been disclosed. While specific embodiments and applications of this invention have been shown and described, it would be apparent to those skilled in the art that many more modifications are possible without departing from the inventive concepts herein. The invention, therefore, is not to be restricted except in the spirit of the appended claims.

What is claimed is:

1. A golf practice device comprising a shaft;

a plurality of bright light sources having visually distinguishable colors, said light sources coupled to said shaft and positioned such that when said shaft is grasped by a person and swung as a golf club, said light sources are sufficiently bright to leave an after-image in the eyes of said person, and can be viewed by said person as tracing out distinct color patterns which visually distinguish a square swing from a non-square swing.

2. The device of claim 1 further comprising a head having a crown and two light sources disposed along said crown.

3. The device of claim 2 wherein said head further comprises a face containing a sweet spot, and wherein said light sources are co-planar with a visual line of sight extending from said golfer to said sweet spot.

4. The device of claim 1 wherein at least one of said light sources is a light emitting diode.

5. The device of claim 1 wherein at least one of said light sources is powered by a battery.

6. The device of claim 5 further comprising an inertial switch electrically coupled to said battery and said light sources, whereby said switch controls electrical power to at least one of said battery-powered light sources.

7. An improved golf club having a head, said improvement comprising:

a plurality of bright light sources having visually distinguishable colors attached to said head and aligned relative to each other such that when said club is swung with a square swing by a golfer, said light sources trace individual arcs which appear to said golfer as distinct superimposed visual patterns having a color which is a combination of the various colors of said individual arcs, and when said club is swung with a non-square swing, said light sources trace arcs which appear to said golfer as distinct non-superimposed visual patterns.

* * * * *